US008322708B2

(12) United States Patent
Liu

(10) Patent No.: US 8,322,708 B2
(45) Date of Patent: Dec. 4, 2012

(54) PAPER STOPPER MECHANISM FOR PAPER-FEEDING APPARATUS

(75) Inventor: Shi-Ze Liu, Taipei (TW)

(73) Assignee: Kinpo Electronics, Inc., Taipei (TW)

( * ) Notice: Subject to any disclaimer, the term of this patent is extended or adjusted under 35 U.S.C. 154(b) by 552 days.

(21) Appl. No.: 12/453,793

(22) Filed: May 22, 2009

(65) Prior Publication Data

US 2010/0295234 A1 Nov. 25, 2010

(51) Int. Cl.
*B65H 3/52* (2006.01)

(52) U.S. Cl. ..... 271/124; 271/121

(58) Field of Classification Search ..... 271/121, 271/124, 114, 116, 117
See application file for complete search history.

(56) References Cited

U.S. PATENT DOCUMENTS

| | | | | |
|---|---|---|---|---|
| 1,887,023 | A * | 11/1932 | Hunziker | 271/220 |
| 2,916,286 | A * | 12/1959 | Keating | 271/220 |
| 2,991,999 | A * | 7/1961 | Doerner | 271/220 |
| 3,805,971 | A * | 4/1974 | Behrens et al. | 414/789 |
| 5,260,759 | A * | 11/1993 | Kobayashi | 399/405 |
| 5,284,337 | A * | 2/1994 | Ettischer et al. | 271/220 |
| 5,467,974 | A * | 11/1995 | Ishiwata et al. | 271/220 |
| 5,524,877 | A * | 6/1996 | Weber et al. | 271/220 |
| 6,349,931 | B1 * | 2/2002 | Kuo et al. | 271/110 |
| 6,431,541 | B2 * | 8/2002 | Kuo et al. | 271/118 |
| 6,764,072 | B2 * | 7/2004 | Gaarder | 271/121 |
| 6,991,227 | B2 * | 1/2006 | Kim | 271/10.12 |
| 7,059,596 | B2 * | 6/2006 | Iwase | 271/114 |
| 7,210,677 | B2 * | 5/2007 | Fukumura et al. | 271/10.01 |
| 7,543,811 | B2 * | 6/2009 | Shimamura | 271/124 |
| 7,566,052 | B2 * | 7/2009 | Hsu et al. | 271/121 |
| 7,651,082 | B2 * | 1/2010 | Hendrix et al. | 271/121 |
| 7,677,557 | B2 * | 3/2010 | Ino | 271/220 |
| 7,686,296 | B2 * | 3/2010 | Kaneko et al. | 271/220 |
| 7,828,288 | B2 * | 11/2010 | Kim et al. | 271/200 |
| 7,891,658 | B2 * | 2/2011 | Chen et al. | 271/121 |
| 2002/0158406 | A1 * | 10/2002 | Moeller et al. | 271/220 |
| 2002/0190457 | A1 * | 12/2002 | Gaarder | 271/109 |
| 2003/0160385 | A1 * | 8/2003 | Furusawa | 271/220 |
| 2004/0065992 | A1 * | 4/2004 | Youn | 271/121 |
| 2004/0251608 | A1 * | 12/2004 | Saito et al. | 271/220 |
| 2006/0038339 | A1 * | 2/2006 | Shimamura | 271/121 |
| 2006/0049572 | A1 * | 3/2006 | Miyazawa | 271/121 |
| 2006/0071413 | A1 * | 4/2006 | Kaneko et al. | 271/220 |
| 2007/0069454 | A1 * | 3/2007 | Ino | 271/220 |
| 2009/0001659 | A1 * | 1/2009 | McNamara et al. | 271/220 |
| 2009/0273137 | A1 * | 11/2009 | Chen et al. | 271/121 |

FOREIGN PATENT DOCUMENTS

JP 04140233 A * 5/1992

* cited by examiner

*Primary Examiner* — Prasad Gokhale
(74) *Attorney, Agent, or Firm* — Bacon & Thomas, PLLC

(57) ABSTRACT

A paper stopper mechanism for paper-feeding apparatus, which has simplified structure and commonly uses one motor to stop papers. The paper stopper mechanism includes a rotary shaft driven by a drive shaft via a gear assembly, a stopper plate disposed on the rotary shaft, which is movable between a first position and a second position along with the rotation of the rotary shaft, and a resilient member positioned between the rotary shaft and a transmission gear of the gear assembly. There is frictional force between the rotary shaft and the transmission gear, whereby the transmission gear can drive the rotary shaft to rotate. When the stopper plate and the rotary shaft stop at the second position, the transmission gear can still transmit power to a pickup roller to feed a paper into the paper-feeding apparatus without any error.

42 Claims, 7 Drawing Sheets

PAPER STOPPER MECHANISM FOR PAPER-FEEDING APPARATUS

BACKGROUND OF THE INVENTION

The present invention is related to a paper stopper mechanism for paper-feeding apparatus of an office machine, and more particularly to a paper stopper mechanism movable between a first position and a second position by means of frictional force.

A conventional office machine such as a printer is equipped with a paper-feeding apparatus to feed papers into the office machine for faxing, printing or scanning operation. FIG. 1 shows a typical paper-feeding apparatus 10 including rollers for picking and feeding documents or papers p into the machine. In order to truly feed the papers p through the paper-feeding passage 13, a paper stopper mechanism 20 is disposed between the paper-feeding roller 11 and the pickup roller 12. The paper stopper mechanism 20 includes a stopper plate 21 for abutting against front edges of the papers p and keeping the papers p in their true positions before picked up. This can avoid deflection of the papers p in the delivery process or failure of delivery.

When the paper-feeding apparatus is driven to pick up and feed the papers, the stopper plate 21 is moved away as shown by the phantom lines of FIG. 1, permitting the papers p to successfully enter the paper-feeding passage 13. This is accomplished by means of an electromagnetic coil and a cooperative complicated controlling program. Therefore, the paper-feeding apparatus and the paper stopper mechanism are manufactured at high cost.

Another type of conventional paper stopper mechanism employs multiple step motors to respectively control the movements of the gear assembly of the paper-feeding apparatus and the stopper plate. The stopper plate is movable or swingable between a first position and a second position. Two stopper sections (such as protruding posts) are disposed in the first and second positions for stopping the stopper plate at the first and second positions. Accordingly, the movement of the stopper plate is restricted within a set range so as to obviate damage.

However, due to inertia, when the stopper plate is driven by the gear assembly to collide the stopper sections (protruding posts), the stopper plate will rebound from its true position to cause errors. Such errors will sum up to make the stopper plate stop at an incorrect position in follow-up operation. Moreover, such structure is relatively complicated and hard to assemble. As a result, the manufacturing cost is higher.

It is therefore tried by the applicant to provide an improved paper stopper mechanism for paper-feeding apparatus, which can be operated to truly stop at a set position without using any additional transmission mechanism (such as motor) or controlling process. In this case, the structure of the paper stopper mechanism can be simplified to save assembling labor and time. Moreover, without any complicated controlling process or step motor, the manufacturing cost of the paper stopper mechanism is lowered.

SUMMARY OF THE INVENTION

It is therefore a primary object of the present invention to provide a paper stopper mechanism for paper-feeding apparatus, which has simplified structure and commonly uses one motor to stop papers. The paper stopper mechanism includes a rotary shaft driven by a drive shaft via a gear assembly, a stopper plate disposed on the rotary shaft and movable between a first position and a second position along with the rotation of the rotary shaft, and a resilient member positioned between the rotary shaft and a transmission gear of the gear assembly. The rotary shaft and the transmission gear frictionally interfere with the resilient member to provide a frictional force in movement. Accordingly, the transmission gear can drive the rotary shaft to rotate by means of the frictional force. When the stopper plate and the rotary shaft stop at the second position, the transmission gear can still transmit power to a pickup roller to feed a paper into the paper-feeding apparatus without any error. The paper stopper mechanism can be operated without any additional complicated controlling process or step motor so that the manufacturing cost is lowered.

According to the above object, in the paper stopper mechanism for paper-feeding apparatus of the present invention, the rotary shaft has a free end on which the resilient member is fitted and a restriction section disposed at the free end. The restriction section presses against a first side of the resilient member. The transmission gear is formed with a cavity for accommodating the resilient member. The free end of the rotary shaft extends into the cavity. A bottom section of the cavity presses against a second side of the resilient member. The rotary shaft and the transmission gear frictionally interfere with the resilient member to provide a frictional force in movement. Accordingly, the transmission gear can drive the rotary shaft to rotate by means of the frictional force.

The paper stopper mechanism and the paper-feeding apparatus are installed in an enclosure. The enclosure has a first stopper section and a second stopper section, which are disposed on an inner wall face of the enclosure adjacent to the first and second positions of the stopper plate. When the stopper plate is moved to the first or second position and stopped by the first or second stopper section, the transmission gear can frictionally drive the rotary shaft and the stopper plate via the resilient member to keep the stopper plate leant on the first or second stopper section without rebounding.

The present invention can be best understood through the following description and accompanying drawings wherein:

DETAILED DESCRIPTION OF THE PREFERRED EMBODIMENTS

Figure 1:
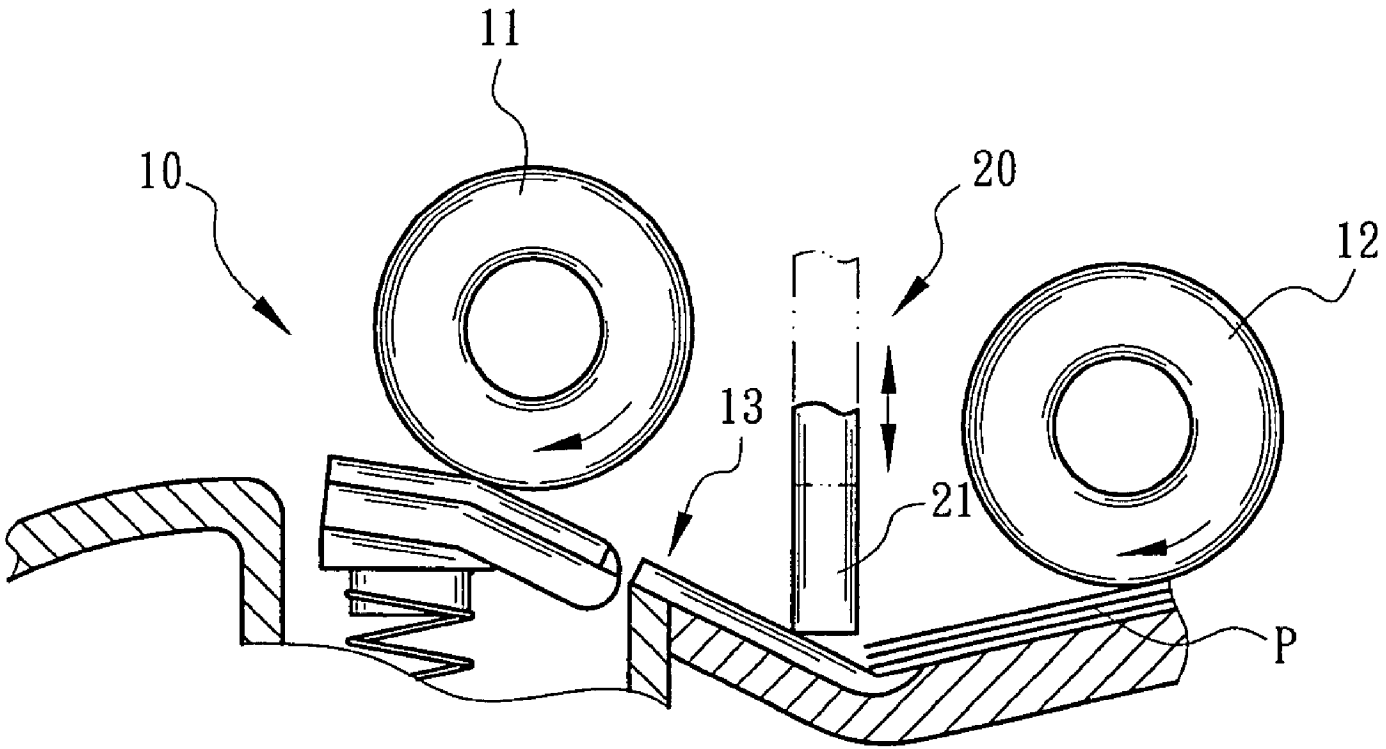
Fig. 1 PRIOR ART
FIG. 1 is a view showing a conventional paper stopper mechanism.
Figure 2:
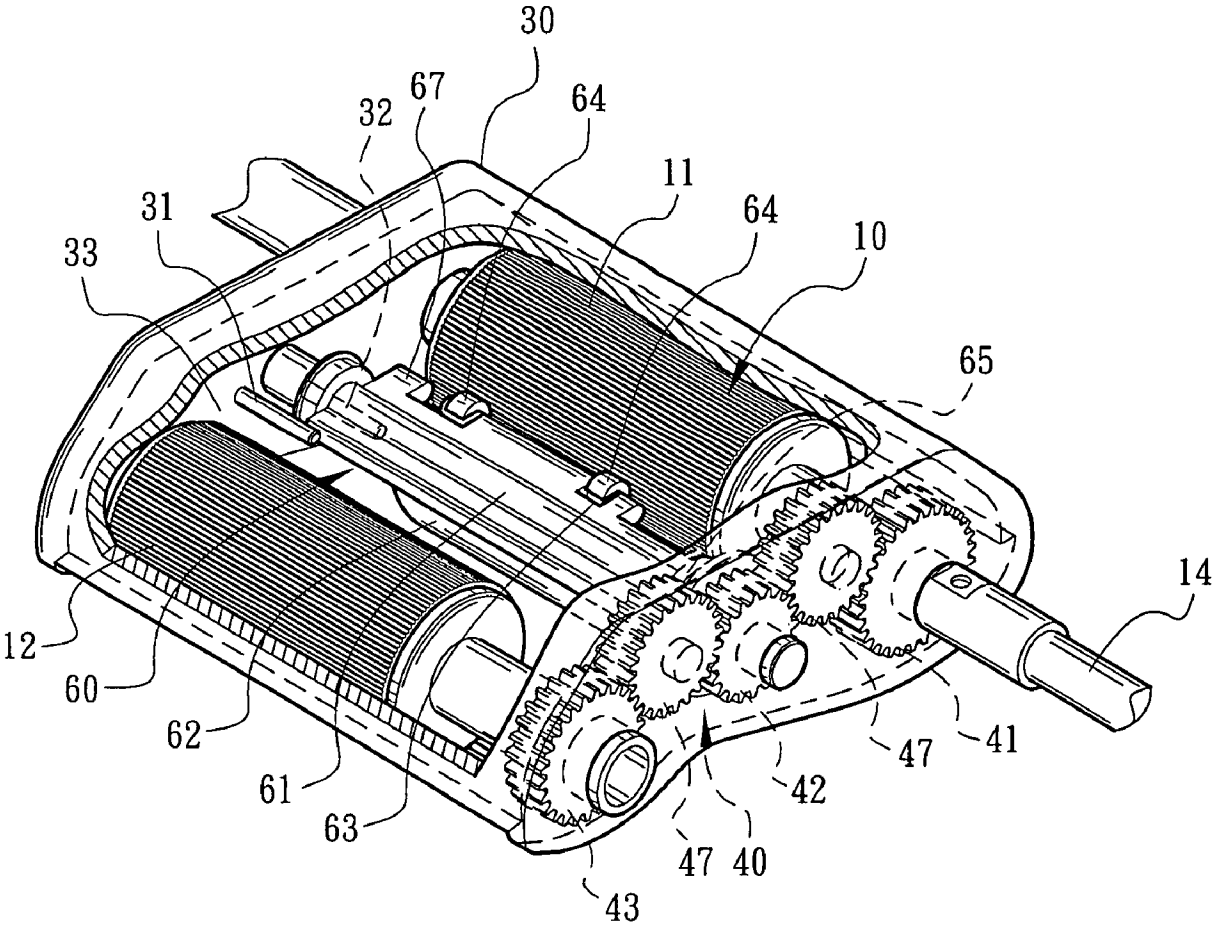
FIG. 2 is a perspective assembled view of the present invention, showing that the paper-feeding apparatus and the paper stopper mechanism are arranged in an enclosure.
Figure 3:
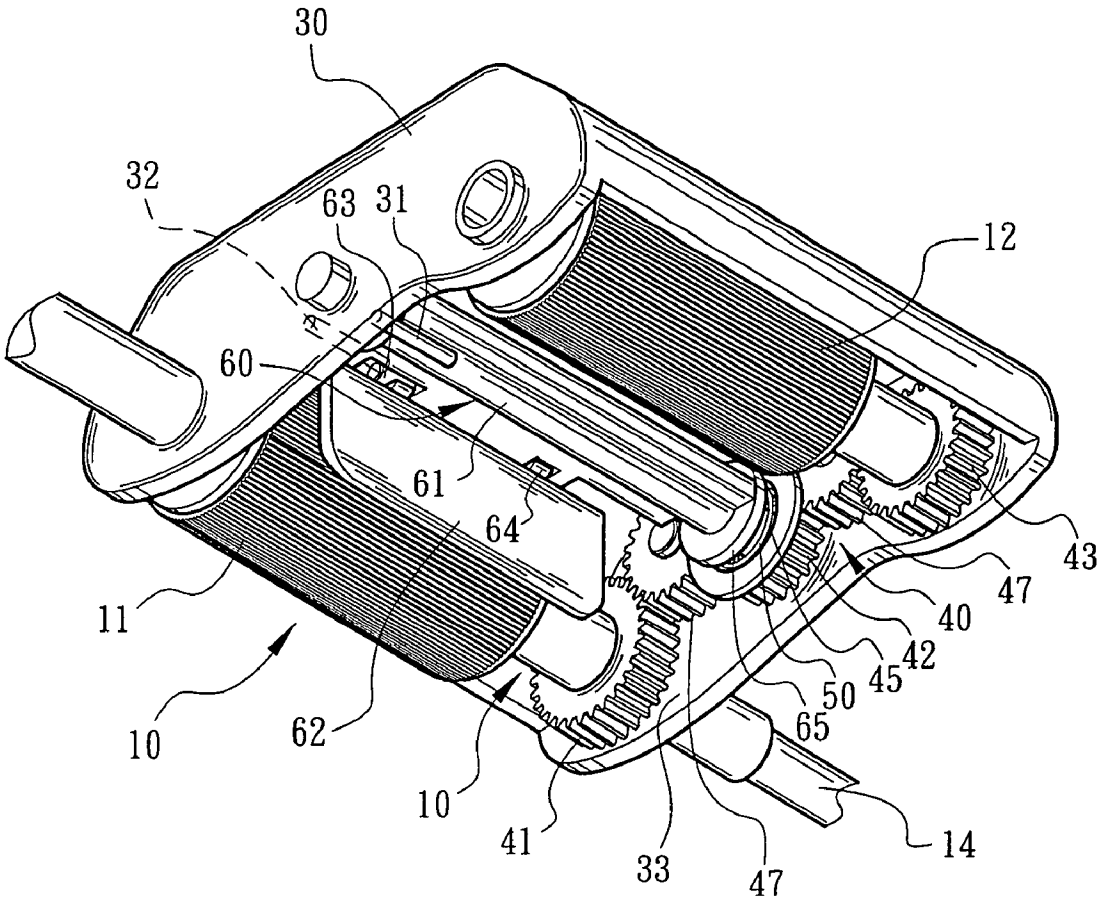
FIG. 3 is another perspective assembled view of the present invention as seen in another direction.
Figure 4:
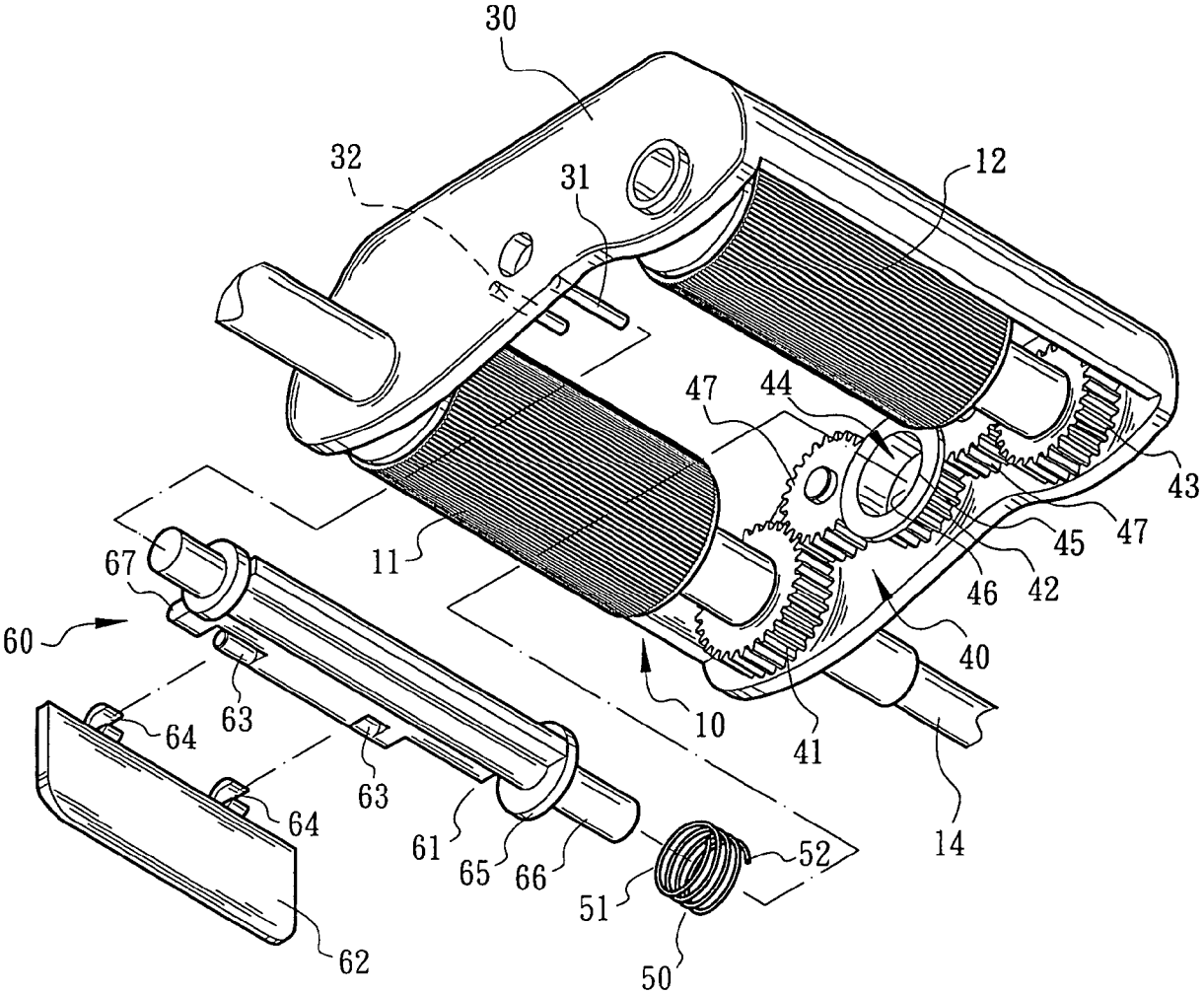
FIG. 4 is a perspective exploded view of the present invention according to FIG. 3.

Please refer to FIGS. 2, 3 and 4. The paper stopper mechanism for paper-feeding apparatus of the present invention is installed in an enclosure 30. As shown in FIG. 2, the enclosure 30 has a first stopper section 31 and a second stopper section 32, which are disposed on an inner wall face 33 of the enclosure 30 to restrict movement of the paper stopper mechanism 60 within a certain range. In this embodiment, the paper-feeding apparatus 10 includes a paper-feeding roller 11, a pickup roller 12 and a gear assembly 40. The paper-feeding roller 11 is mounted on a drive shaft 14 drivable by a motor (not shown). The gear assembly 40 includes a drive gear 41 mounted on the drive shaft 14, a transmission gear 42 and a driven gear 43 mounted on the pickup roller 12. When the motor drives the drive shaft 14, the drive gear 41 and the paper-feeding roller 11 are driven and rotated. At the same time, the transmission gear 42, the driven gear 43 and the pickup roller 12 are driven and rotated. Preferably, an idler 47 is arranged between the drive gear 41 and the transmission gear 42 and another idler 47 is arranged between the transmission gear 42 and the driven gear 43.

Referring to FIG. 4, the transmission gear 42 is formed with a cavity 44 for accommodating a resilient member 50. (This will be further described hereinafter.) The cavity 44 has an opening 45 and a bottom section 46. In this embodiment, the transmission gear 42 is assembled with the paper stopper mechanism 60. The paper stopper mechanism 60 includes a rotary shaft 61 and a stopper plate 62 pivotally connected with the rotary shaft 61. The rotary shaft 61 has an insertion section 63 and the stopper plate 62 has an insertion section 64 corresponding to the insertion section 63. The insertion section 64 is insert-connected with the insertion section 63 of the rotary shaft 61 to fix the stopper plate 62 on the rotary shaft 61.

In a preferred embodiment, the insertion section 64 of the stopper plate 62 is a claw-like structure, while the insertion section 63 of the rotary shaft 61 is a rod-like structure. Accordingly, the insertion section 64 of the stopper plate 62 can grasp the insertion section 63 of the rotary shaft 61.

Figure 5:
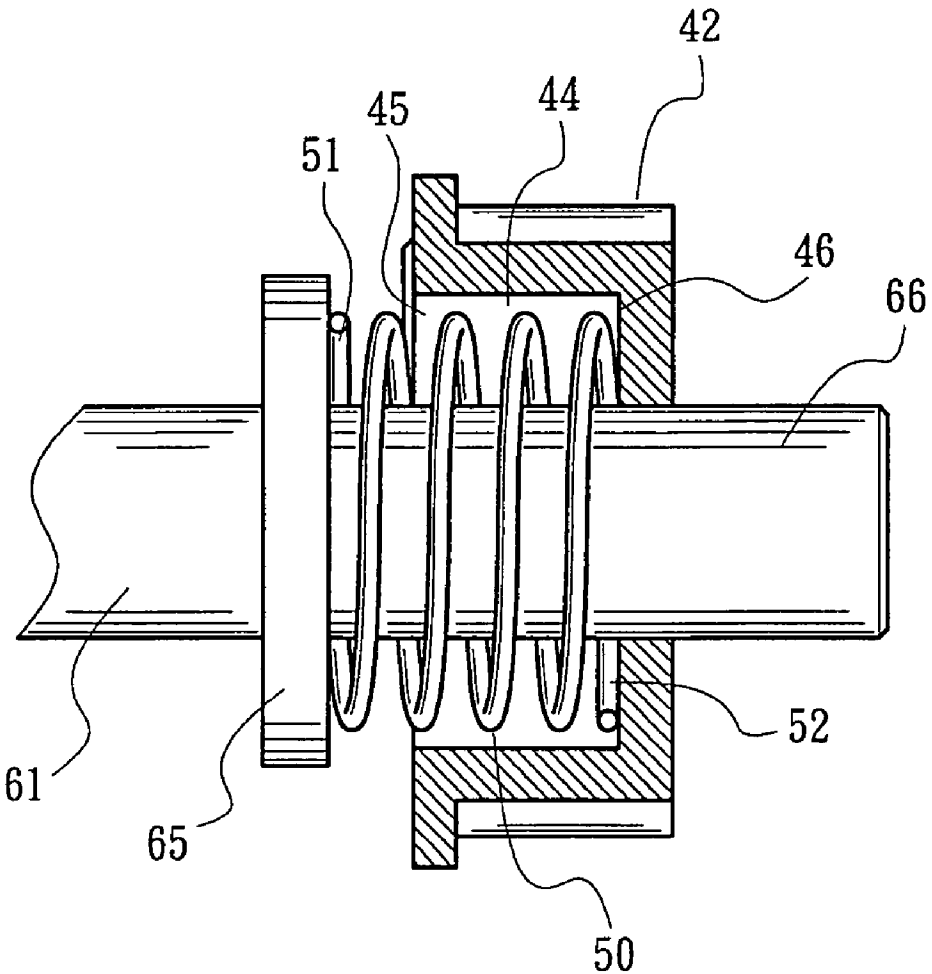
FIG. 5 is a sectional assembled view of a part of the present invention, showing that the rotary shaft, the resilient member and the transmission gear are assembled with each other.

Referring to FIGS. 4 and 5, the rotary shaft 61 has a restriction section 65 and a free end 66 extending into the cavity 44 of the transmission gear 42. In this embodiment, the restriction section 65 has the form of a disc. The rotary shaft 61 further has a stopper section 67. When the rotary shaft 61 rotates, the stopper section 67 will interfere with the first stopper section 31 and the second stopper section 32 of the enclosure 30.

Referring to FIG. 5, according to a preferred embodiment, the resilient member 50 is made of elastic rubber material or the like. In this embodiment, the resilient member 50 is a coiled spring fitted on the free end 66 of the rotary shaft 61 and received in the cavity 44 of the transmission gear 42 along with the free end 66. The resilient member 50 has a first side 51 and a second side 52. The restriction section 65 of the rotary shaft 61 and the bottom section 46 of the cavity 44 respectively press against the first and second sides 51, 52 of the resilient member 50. Accordingly, the restriction section 65 of the rotary shaft 61 and the bottom section 46 of the cavity 44 frictionally interfere with the resilient member 50 to provide a frictional force in movement. To speak more specifically, the transmission gear 42 drives and rotates the rotary shaft 61 through the frictional force.

Figure 6:
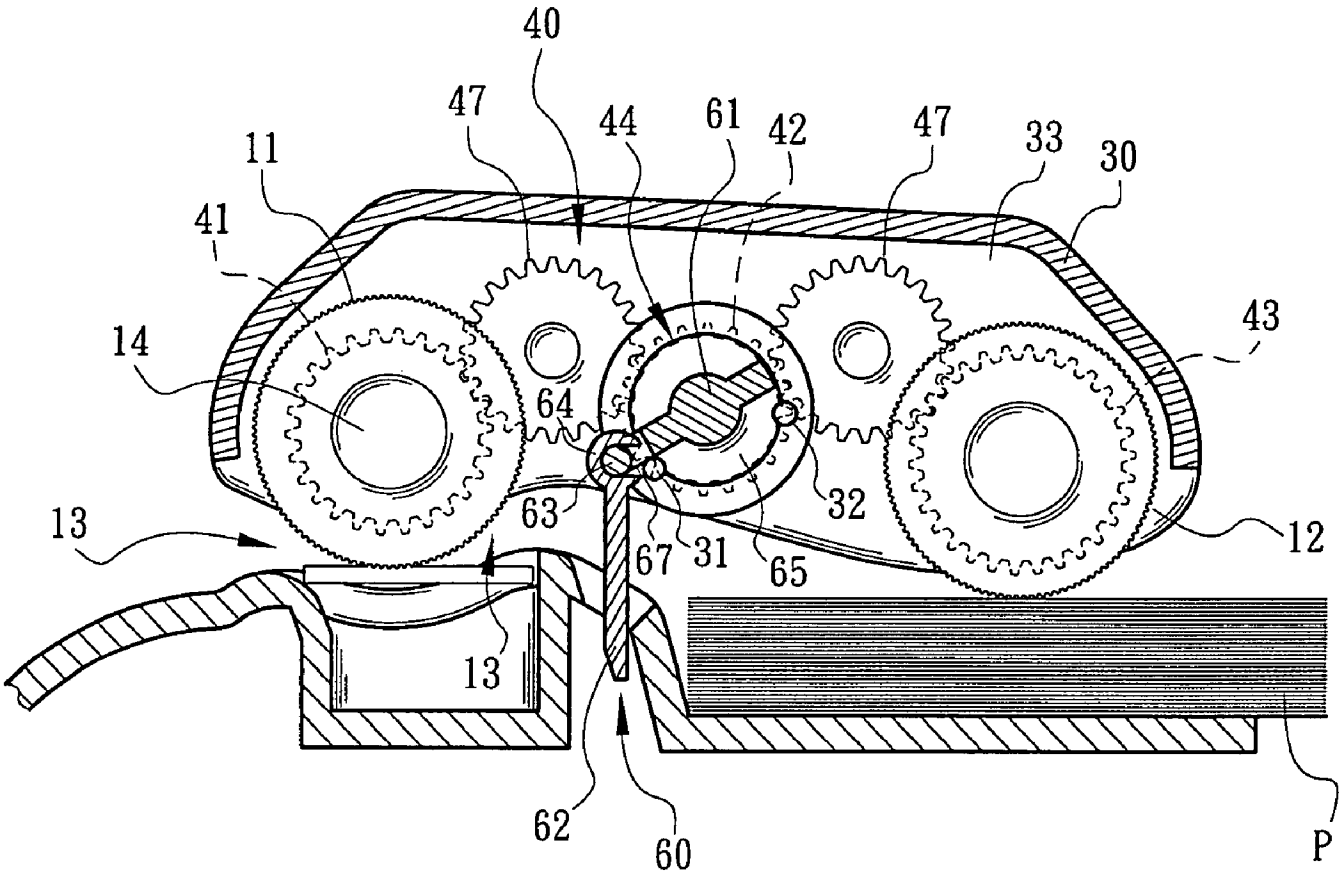
FIG. 6 is a sectional view of the present invention, showing that the restriction section of the rotary shaft and the stopper plate are positioned in a first position.
Figure 7:
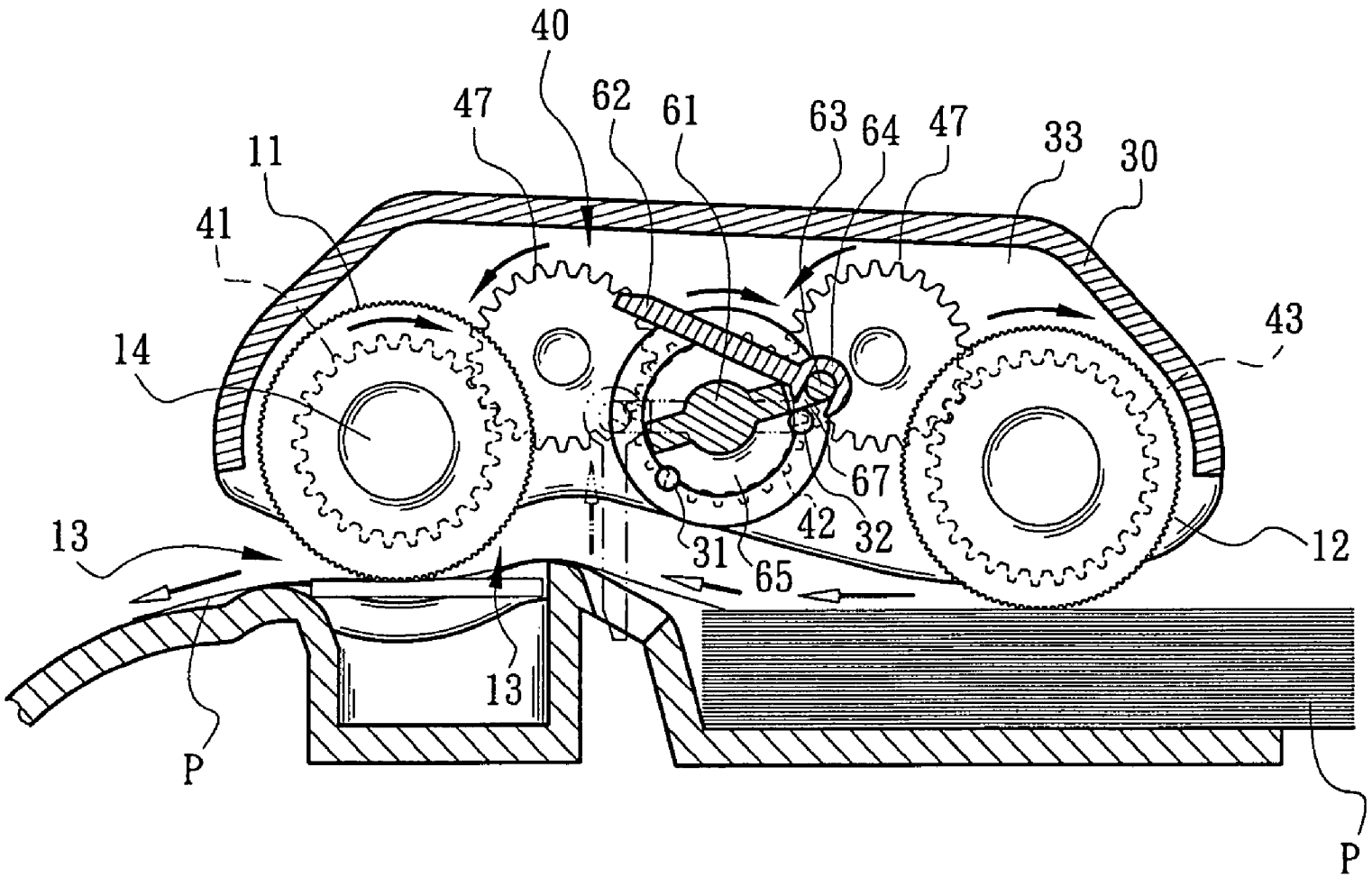
FIG. 7 is a sectional view of the present invention, showing that the restriction section of the rotary shaft and the stopper plate are positioned in a second position.

FIG. 6 shows that the stopper section 67 of the rotary shaft 61 is leant against the first stopper section 31 in a first position where the stopper plate 62 blocks a paper-feeding passage 13. FIG. 7 shows that the stopper section 67 of the rotary shaft 61 is leant against the second stopper section 32 in a second position where the stopper plate 62 unblocks the paper-feeding passage 13.

Referring to FIGS. 6 and 7, when the drive shaft 14 and the drive gear 41 are driven and clockwise rotated by the motor in a direction of the arrow as shown in FIG. 7, via the idler 47, the transmission gear 42 is rotated clockwise. At this time, through the frictional force, the transmission gear 42 drives and rotates the rotary shaft 61 to make the stopper section 67 move from the first position to the second position to unblock the paper-feeding passage 13. At the same time, the transmission gear 42 also drives the driven gear 43 to make the pickup roller 12 rotate clockwise as shown in FIG. 7. At this time, a paper p is picked into the paper-feeding passage 13 for printing, faxing or scanning operation. After the operation is completed, the drive shaft 14 and the drive gear 41 are driven and rotated by the motor in a reverse direction. In this case, the transmission gear 42 will drive the rotary shaft 61 and the stopper section 67 to move from the second position to the first position until the stopper section 67 is stopped by the first stopper section 31. Under such circumstance, the stopper plate 62 blocks the paper-feeding passage 13 again as shown in FIG. 6.

It should be noted that when the stopper section 67 moves from the first position to the second position and reaches the second position, the stopper section 67 will be stopped by the second stopper section 32 from further moving. This is because the frictional force applied by the transmission gear 42 to the rotary shaft 61 is not greater than the stopping force of the second stopper section 32. However, the frictional force will keep the stopper section 67 of the rotary shaft 61 leant against the second stopper section 32 so that the stopper plate 62 can truly stay in the second position without rebounding as in the prior art. Similarly, when the stopper section 67 is stopped by the first stopper section 31, the stopper plate 62 will truly stay in the first position. Accordingly, the frictional force can overcome the rebounding force exerted onto the stopper plate when colliding the stopper section.

It should be noted that alternatively, the transmission gear 42 can be a solid structure having a plane face without any hollow section. The plane face of the transmission gear 42 serves to press against the second side 52 of the resilient member 50 to achieve the same effect as the above embodiment.

Accordingly, the paper stopper mechanism for the paper-feeding apparatus of the present invention can operate without any additional transmission mechanism (such as motor) or controlling process. The present invention has the following advantages:

1. The resilient member 50 is disposed between the rotary shaft 61 and the transmission gear 42. The rotary shaft 61 and the transmission gear 42 frictionally interfere with the resilient member 50 to provide a frictional force in movement. Through the frictional force, the transmission gear 42 drives the stopper plate 62 to move between the first and second positions. The structure of the present invention is simplified to save assembling labor and time. Moreover, the present invention is operable without using any complicated controlling process or step motor so that the manufacturing cost is lowered.
2. The stopper plate 62 is moved in a pattern different from that of the prior art. The frictional force will keep the restriction section of the rotary shaft 61 leant against the first stopper section 31 or the second stopper section 32 so that the stopper plate 62 can truly stay in the first or second position without rebounding as in the prior art.

The above embodiments are only used to illustrate the present invention, not intended to limit the scope thereof. Many modifications of the above embodiments can be made without departing from the spirit of the present invention.

What is claimed is:

1. A paper stopper mechanism for a paper-feeding apparatus, comprising:

a rotary shaft drivable by a transmission gear;

a stopper plate disposed on the rotary shaft and movable between a first position and a second position along with the rotation of the rotary shaft; and a resilient member disposed between the rotary shaft and the transmission gear, the rotary shaft and the transmission gear frictionally interfering with the resilient member to provide a frictional force for the transmission gear to drive and rotate the rotary shaft, wherein the rotary shaft has an insertion section for insert-connecting with an insertion section of the stopper plate so as to fix the stopper plate on the rotary shaft.

2. The paper stopper mechanism for a paper-feeding apparatus as claimed in claim 1, wherein the paper stopper mechanism is installed in an enclosure, the enclosure having a first stopper section and a second stopper section, which are disposed on an inner wall face of the enclosure.

3. The paper stopper mechanism for a paper-feeding apparatus as claimed in claim 1, wherein the transmission gear is drivable by a drive shaft.

4. The paper stopper mechanism for a paper-feeding apparatus as claimed in claim 3, wherein a drive gear is disposed on the drive shaft for driving the transmission gear.

5. The paper stopper mechanism for a paper-feeding apparatus as claimed in claim 4, wherein an idler is arranged between the drive gear and the transmission gear.

6. The paper stopper mechanism for a paper-feeding apparatus as claimed in claim 1, wherein the transmission gear is formed with a cavity for accommodating the resilient member, the cavity having an opening and a bottom section.

7. The paper stopper mechanism for a paper-feeding apparatus as claimed in claim 1, wherein the insertion section of the stopper plate is a claw-like structure, while the insertion section of the rotary shaft is a rod-like structure, whereby the insertion section of the stopper plate can grasp the insertion section of the rotary shaft.

8. The paper stopper mechanism for a paper-feeding apparatus as claimed in claim 1, wherein the resilient member is a coiled spring having a first side and a second side, the rotary shaft and the transmission gear respectively pressing against the first and second sides of the resilient member to frictionally interfere with the resilient member.

9. The paper stopper mechanism for a paper-feeding apparatus as claimed in claim 1, wherein the rotary shaft has a restriction section, a free end and a stopper section.

10. The paper stopper mechanism for a paper-feeding apparatus as claimed in claim 9, wherein the restriction section has the form of a disc.

11. The paper stopper mechanism for a paper-feeding apparatus as claimed in claim 9, wherein the stopper section is movable between the first stopper section and the second stopper section.

12. The paper stopper mechanism for a paper-feeding apparatus as claimed in claim 1, wherein the transmission gear is a solid structure having a plane face for pressing against one side of the resilient member.

13. The paper stopper mechanism for a paper-feeding apparatus as claimed in claim 1, wherein the paper stopper mechanism and the paper-feeding apparatus are installed in an enclosure.

14. The paper stopper mechanism for a paper-feeding apparatus as claimed in claim 1, wherein the transmission gear serves to drive a driven gear.

15. The paper stopper mechanism for a paper-feeding apparatus as claimed in claim 14, wherein an idler is arranged between the transmission gear and the driven gear.

16. A paper stopper mechanism for a paper-feeding apparatus, comprising:

a rotary shaft drivable by a transmission gear;

a stopper plate disposed on the rotary shaft and movable between a first position and a second position along with the rotation of the rotary shaft; and a resilient member disposed between the rotary shaft and the transmission gear, the rotary shaft and the transmission gear frictionally interfering with the resilient member to provide a frictional force for the transmission gear to drive and rotate the rotary shaft, wherein the rotary shaft has a restriction section, a free end and a stopper section, wherein the resilient member is fitted on the free end of the rotary shaft and confined between the restriction section and the transmission gear;

wherein the transmission gear is formed with a cavity for accommodating the resilient member, the cavity having an opening and a bottom section.

17. The paper stopper mechanism for a paper-feeding apparatus as claimed in claim 16, wherein the paper stopper mechanism is installed in an enclosure, the enclosure having a first stopper section and a second stopper section, which are disposed on an inner wall face of the enclosure.

18. The paper stopper mechanism for a paper-feeding apparatus as claimed in claim 17, wherein the stopper section is movable between the first stopper section and the second stopper section.

19. The paper stopper mechanism for a paper-feeding apparatus as claimed in claim 16, wherein the transmission gear is drivable by a drive shaft.

20. The paper stopper mechanism for a paper-feeding apparatus as claimed in claim 16, wherein a drive gear is disposed on the drive shaft for driving the transmission gear.

21. The paper stopper mechanism for a paper-feeding apparatus as claimed in claim 20, wherein an idler is arranged between the drive gear and the transmission gear.

22. The paper stopper mechanism for a paper-feeding apparatus as claimed in claim 16, wherein the resilient member is a coiled spring having a first side and a second side, the rotary shaft and the transmission gear respectively pressing against the first and second sides of the resilient member to frictionally interfere with the resilient member.

23. The paper stopper mechanism for a paper-feeding apparatus as claimed in claim 16, wherein the transmission gear is a solid structure having a plane face for pressing against one side of the resilient member.

24. The paper stopper mechanism for a paper-feeding apparatus as claimed in claim 16, wherein the paper stopper mechanism and the paper-feeding apparatus are installed in an enclosure.

25. The paper stopper mechanism for a paper-feeding apparatus as claimed in claim 16, wherein the transmission gear serves to drive a driven gear.

26. The paper stopper mechanism for a paper-feeding apparatus as claimed in claim 25, wherein an idler is arranged between the transmission gear and the driven gear.

27. A paper stopper mechanism for a paper-feeding apparatus, comprising:

a rotary shaft drivable by a transmission gear;

a stopper plate disposed on the rotary shaft and movable between a first position and a second position along with the rotation of the rotary shaft; and a resilient member disposed between the rotary shaft and the transmission gear, the rotary shaft and the transmission gear frictionally interfering with the resilient member to provide a frictional force for the transmission gear to drive and rotate the rotary shaft, wherein the rotary shaft has a restriction section, a free end and a stopper section, wherein the resilient member is fitted on the free end of the rotary shaft and confined between the restriction section and the transmission gear;

wherein the rotary shaft has an insertion section for insert-connecting with an insertion section of the stopper plate so as to fix the stopper plate on the rotary shaft.

28. The paper stopper mechanism for a paper-feeding apparatus as claimed in claim 27, wherein the insertion section of the stopper plate is a claw-like structure, while the insertion section of the rotary shaft is a rod-like structure, whereby the insertion section of the stopper plate can grasp the insertion section of the rotary shaft.

29. A paper stopper mechanism for a paper-feeding apparatus, comprising:

a rotary shaft drivable by a transmission gear;

a stopper plate disposed on the rotary shaft and movable between a first position and a second position along with the rotation of the rotary shaft; and a resilient member disposed between the rotary shaft and the transmission gear, the rotary shaft and the transmission gear frictionally interfering with the resilient member to provide a frictional force for the transmission gear to drive and rotate the rotary shaft, wherein the rotary shaft has a restriction section, a free end and a stopper section, wherein the stopper section is movable between a first stopper section and a second stopper section.

30. The paper stopper mechanism for a paper-feeding apparatus as claimed in claim 29, wherein the paper stopper mechanism is installed in an enclosure, the enclosure having a first stopper section and a second stopper section, which are disposed on an inner wall face of the enclosure.

31. The paper stopper mechanism for a paper-feeding apparatus as claimed in claim 29, wherein the transmission gear is drivable by a drive shaft.

32. The paper stopper mechanism for a paper-feeding apparatus as claimed in claim 31, wherein a drive gear is disposed on the drive shaft for driving the transmission gear.

33. The paper stopper mechanism for a paper-feeding apparatus as claimed in claim 32, wherein an idler is arranged between the drive gear and the transmission gear.

34. The paper stopper mechanism for a paper-feeding apparatus as claimed in claim 29, wherein the transmission gear is formed with a cavity for accommodating the resilient member, the cavity having an opening and a bottom section.

35. The paper stopper mechanism for a paper-feeding apparatus as claimed in claim 29, wherein the rotary shaft has an insertion section for insert-connecting with an insertion section of the stopper plate so as to fix the stopper plate on the rotary shaft.

36. The paper stopper mechanism for a paper-feeding apparatus as claimed in claim 35, wherein the insertion section of the stopper plate is a claw-like structure, while the insertion section of the rotary shaft is a rod-like structure, whereby the insertion section of the stopper plate can grasp the insertion section of the rotary shaft.

37. The paper stopper mechanism for a paper-feeding apparatus as claimed in claim 29, wherein the resilient member is a coiled spring having a first side and a second side, the rotary shaft and the transmission gear respectively pressing against the first and second sides of the resilient member to frictionally interfere with the resilient member.

38. The paper stopper mechanism for a paper-feeding apparatus as claimed in claim 29, wherein the resilient member is fitted on the free end of the rotary shaft and confined between the restriction section and the transmission gear.

39. The paper stopper mechanism for a paper-feeding apparatus as claimed in claim 29, wherein the transmission gear is a solid structure having a plane face for pressing against one side of the resilient member.

40. The paper stopper mechanism for a paper-feeding apparatus as claimed in claim 29, wherein the paper stopper mechanism and the paper-feeding apparatus are installed in an enclosure.

41. The paper stopper mechanism for a paper-feeding apparatus as claimed in claim 29, wherein the transmission gear serves to drive a driven gear.

42. The paper stopper mechanism for a paper-feeding apparatus as claimed in claim 41, wherein an idler is arranged between the transmission gear and the driven gear.

* * * * *